US010370911B2

(12) United States Patent
Curry et al.

(10) Patent No.: US 10,370,911 B2
(45) Date of Patent: Aug. 6, 2019

(54) METHODS AND SYSTEMS FOR DRILLING BOREHOLES IN EARTH FORMATIONS

(71) Applicants: Baker Hughes Incorporated, Houston, TX (US); BP Exploration Operating Company Limited, Sunbury-on-Thames, Middlesex (GB)

(72) Inventors: David A. Curry, Princes Risborough (GB); Rudolf Carl Pessier, Houston, TX (US); Reed W. Spencer, Spring, TX (US); Andrea Kuesters, Middlesex (GB); John Wingate, Middlesex (GB)

(73) Assignees: Baker Hughes Incorporated, Houston, TX (US); BP Exploration Operating Company Limited, Sunbury-on-Thames (GB)

( * ) Notice: Subject to any disclaimer, the term of this patent is extended or adjusted under 35 U.S.C. 154(b) by 226 days.

(21) Appl. No.: 15/373,036

(22) Filed: Dec. 8, 2016

(65) Prior Publication Data

US 2018/0163527 A1 Jun. 14, 2018

(51) Int. Cl.

| | |
|---|---|
| ***E21B 19/00*** | (2006.01) |
| ***E21B 44/00*** | (2006.01) |
| ***E21B 45/00*** | (2006.01) |
| ***E21B 47/04*** | (2012.01) |

(52) U.S. Cl.

CPC ..... *E21B 19/008* (2013.01); *E21B 44/00* (2013.01); *E21B 45/00* (2013.01); *E21B 47/04* (2013.01)

(58) Field of Classification Search

None

See application file for complete search history.

(56) References Cited

U.S. PATENT DOCUMENTS

| | | | | |
|---|---|---|---|---|
| 5,960,896 | A * | 10/1999 | Barr | E21B 10/43 175/431 |
| 8,277,278 | B2 | 10/2012 | Guigne et al. | |
| 8,590,635 | B2 | 11/2013 | Koederitz | |
| 8,838,426 | B2 | 9/2014 | Aldred et al. | |
| 9,027,671 | B2 | 5/2015 | Koederitz | |
| 9,285,794 | B2 | 3/2016 | Wang et al. | |

(Continued)

OTHER PUBLICATIONS

International Search Report for International Application No. PCT/US2017/064454 dated Apr. 5, 2018, 3 pages.

(Continued)

*Primary Examiner* — Nicole Coy
(74) *Attorney, Agent, or Firm* — TraskBritt

(57) ABSTRACT

Methods of drilling earth formations may involve removing a portion of an underlying earth formation utilizing cutting elements of an earth-boring drill bit. A rotational speed of the drill string may be sensed utilizing a first sensor. A rate of penetration of the drill string during advancement of the earth-boring drill bit may be sensed utilizing a second sensor. An instantaneous average depth of cut of cutting elements of the earth-boring drill bit may be determined utilizing a control unit to calculate the instantaneous average depth of cut based on a sensed rotational speed of the drill string and a sensed speed of advancement of the drill string. The weight on the earth-boring drill bit may be increased utilizing the drawworks when the instantaneous average depth of cut is less than the predetermined minimum depth of cut.

18 Claims, 4 Drawing Sheets

(56) References Cited

U.S. PATENT DOCUMENTS

| | | | | |
|---|---|---|---|---|
| 2008/0164062 | A1 | 7/2008 | Brackin et al. | |
| 2010/0191471 | A1 | 7/2010 | de Reynal | |
| 2010/0314173 | A1 | 12/2010 | Hbaieb et al. | |
| 2011/0220410 | A1 | 9/2011 | Aldred et al. | |
| 2014/0136138 | A1 | 5/2014 | Park et al. | |
| 2015/0275648 | A1 | 10/2015 | Wang et al. | |
| 2015/0369031 | A1* | 12/2015 | Yang | E21B 4/02 700/275 |
| 2016/0305231 | A1* | 10/2016 | Majidi | E21B 44/04 |

OTHER PUBLICATIONS

International Written Opinion for International Application No. PCT/US2017/064454 dated Apr. 5, 2018, 10 pages.

Black et al., Optimization of Deep Drilling Performance with Improvements in Drill Bit and Drilling Fluid Design, IADC/SPE Drilling Conference, Mar. 4-6, 2008, IADC/SPE 112731, pp. 1-22.

Bourgoyne, Jr, A.T et al., A multiple Regression Approach to Optimal Drilling and Abnormal Pressure Detection, Society of Petroleum Engineers Journal, vol. 14, No. 4, (Aug. 1974), pp. 371-384.

Chang et al., Field Trial Results of a Drilling Advisory System, International Petroleum Technology Conference, 2014, IPTX 17216, 13 pages.

Chapman et al., Automated Closed-Loop Drilling with ROP Optimization Algorithm Aignificantly Reduces Drilling Time and Improves Downhole Tool Reliability, IADC/SPE Drilling Conference and Exhibition, (Mar. 6-8, 2012), IADC/SPE 151736, pp. 1-7.

Curry et al., The Effect of Borehole Pressure on the Drilling Process in Salt, SPE/IADC Drilling Conference and Exhibition, (Mar. 17-19, 2015), SPE/IADC-173023-MS, pp. 1-18.

Dunlop et al., Increased Rate of Penetration Through Automation, SPE/IADC Drilling Conference and Exhibition, (Mar. 1-3, 2011), SPE/IADC 139897, pp. 1-11.

Dupriest, Fred E., Maximizing Drill Rates with Real-Time Surveillance of Mechanical Specific Energy, SPE/IADC Drilling Conference, (Feb. 23-25, 2005), SPE/IADC 92194, pp. 1-10.

Fear, M.J., How to Improve Rate of Penetration in Field Operations, SPE Drill. & Completion, vol. 14, No. 1, (Mar. 1999), pp. 42-49.

Galle et al., Best Constant Weight and Rotary Speed for Rotary Rock Bits, Drilling and Production Practice, Jan. 1, 1963, pp. 48-73.

Guo, X.Z., A Preliminary Investigation on the Objective Function of Penetration Cost Applied to Optimized Drilling, Society of Petroleum Engineers, vol. 3, No. 4, (Dec. 1, 1988), pp. 411-417.

Maidla et al., Field Verification of Drilling Models and Computerized Selection of Drill Bit, WOB, and Drillstring Rotation, Society of Petroleum Engineers, vol. 6, No. 3, (Sep. 1991), 189-195.

Mensa-Wilmot et al., The Effects of Formation Hardness, Abrasiveness, Heterogeneity and Hole Size on PDC Bit Performance, SPE/IADS Drilling Conferent, (Feb. 27-Mar. 1, 2001), SPE/IADC 67698, pp. 1-14.

Pessier et al., Quantifying Common Drilling Problems with Mechanical Specific Enerty and a Bit-Specific Coefficient of Sliding Friction, SPE Annual Technical Conference and Exhibition, (Oct. 4-7, 1992), SPE 24584, pp. 373-388.

Xu et al., How to Organise Mud Logging Data for medelling Rate of Penetration, SPE Asia Pacific Oil and Gas Conference, (Mar. 20-22, 1995), SPE 29252, pp. 31-38.

Young, Jr., F.S., Computerized Drilling Control, SPE-AIME, Humble Oil & Refining Co., Journal of Petroleum Technology, vol. 21, No. 4, (1969), pp. 483-496.

* cited by examiner

METHODS AND SYSTEMS FOR DRILLING BOREHOLES IN EARTH FORMATIONS

FIELD

This disclosure relates generally to methods of using, and systems including, earth-boring drill bits. More specifically, disclosed embodiments relate to methods of, and systems for, operating earth-boring drill bits that may reduce drilling time, reduce energy input, reduce wear, and improve responsiveness to real-time drilling conditions.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

The illustrations presented in this disclosure are not meant to be actual views of any particular system for drilling boreholes in earth formations or component thereof, but are merely idealized representations employed to describe illustrative embodiments. Thus, the drawings are not necessarily to scale.

Disclosed embodiments relate generally to methods of, and systems for, operating earth-boring drill bits that may reduce drilling time, reduce energy input, reduce wear, and improve responsiveness to real-time drilling conditions. More specifically, disclosed are embodiments of methods of, and systems for, operating earth-boring drill bits that may enable better real-time adjustment of the weight applied to the earth-boring drill bit employing in-operation measurement of drilling parameters to better determine an instantaneous average depth of cut of cutting elements of the earth-boring drill bit. Such methods and systems may enable better determination of whether the instantaneous average depth of cut exceeds or is below a predetermined threshold to increase the likelihood that mechanically efficient drilling is performed. In addition, embodiments within the scope of this disclosure may enable better pre-selection of the weight to be applied to an earth-boring drill bit before drilling.

As used in this disclosure, the term "drilling" means and includes any operation performed during the formation or enlargement of a borehole in a subterranean formation. For example, drilling includes drilling, reaming, and other formation removal processes.

Figure 1:
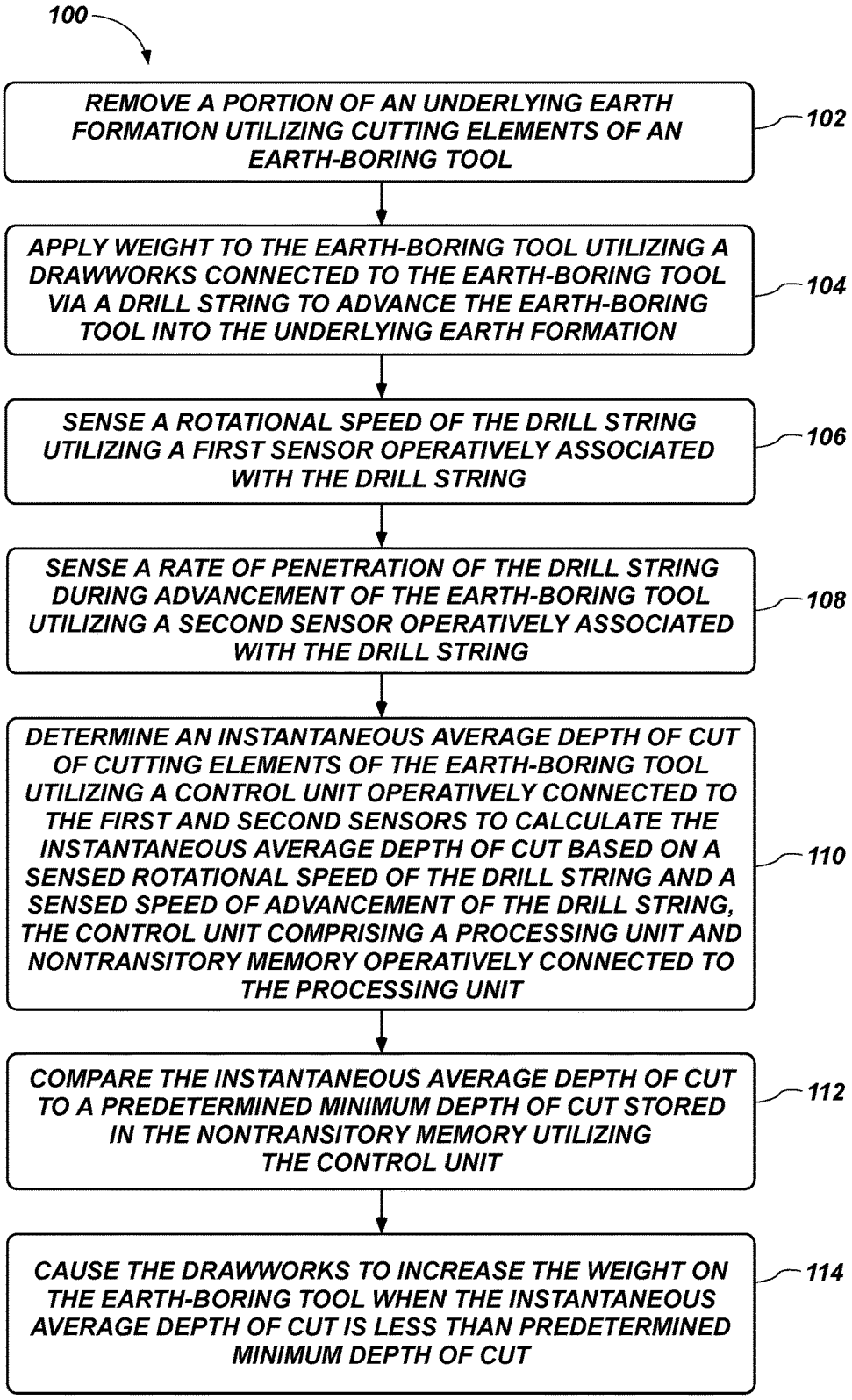
FIG. 1 is a flowchart diagram of a method of drilling an earth formation.

Referring to FIG. 1, a flowchart diagram of a method 100 of drilling an earth formation is shown. The method 100 may involve removing a portion of an underlying earth formation utilizing cutting elements of an earth-boring drill bit, as shown at 102. More specifically, the earth-boring drill bit may be configured as a fixed-cutter earth-boring drill bit, including a body having cutting elements secured fixedly thereto. The cutting elements of the earth-boring drill bit may be driven against the underlying earth formation (e.g., through rotation, impact force, grinding, a combination of these), and may remove portions of the underlying earth formation.

Weight may be applied to the earth-boring drill bit utilizing a drawworks connected to the earth-boring drill bit via a drill string to advance the earth-boring drill bit into the underlying earth formation, as indicated at 104. For example, the drawworks may support the drill string and the earth-boring drill bit at an end of the drill string within a borehole, the drill string and earth-boring drill bit being suspended from the drawworks. The drawworks may selectively permit a portion of the weight of the drill string to bear on the earth-boring drill bit, driving it in an intended direction. The force acting on the earth-boring drill bit to advance it into the underlying earth formation is commonly referred to in the art as "weight on bit."

The manner in which earth material is removed by the cutting elements may be characterized by a primary cutting action. For example, the earth formation may be removed by a combination of shearing and grinding cutting action with one or the other dominating. The energy input required to remove a given volume of earth material (commonly known in the art as "mechanical specific energy") may depend, at least in part, on the cutting action performed by the cutting elements. For example, cutting elements removing earth material by a shearing dominated cutting action may have a substantially lower mechanical specific energy (i.e., may require less energy to remove a given volume of the earth material) particularly in stronger, more consolidated materials. Cutting elements removing earth material by a grinding dominated cutting action may have a much higher mechanical specific energy (i.e., may require more energy to remove the same volume of the earth material) due to the additional friction and heat generated in the less efficient grinding mode.

The depth to which a cutting element is able to penetrate the underlying earth formation during removal (i.e., the "depth of cut") is one factor influencing the primary cutting action of the cutting elements. For example, cutting elements having a depth of cut at a certain threshold or greater may be more likely to remove the underlying earth material by a shearing primary cutting action. Cutting elements having a depth of cut below the threshold may be more likely to remove the underlying earth material by a grinding primary cutting action. Transitioning from one mode to the other or crossing the threshold is recognizable in a step change in drilling efficiency reflected in a drop in specific energy.

The threshold depth of cut may depend on a variety of factors, including the characteristics of the underlying earth formation, the quantity, shape and orientation of the cutting elements, the inclusion or absence of depth-of-cut control features on the earth-boring tool, the fluid pressures above the formation and within its pore spaces, and the weight (axial force) acting on each cutter. A primary way in which drilling operators may influence the depth of cut may be by modulating the weight on bit. For example, increasing the weight on bit may increase the depth of cut while decreasing the weight on bit may decrease the depth of cut.

Determining how much weight on bit to apply conventionally may be determined in stages. Drilling operators may drill sections of an earth formation at two different weights on bit and two different rotational speeds, resulting in four different combinations of drilling parameters and four sections of drilled earth material. The drilling operator may then select the combination of parameters that drilled its section the fastest. Stated another way, the drilling operator may continue to drill at the weight on bit and rotational speed that drilled the greatest distance per unit of time (i.e., achieved the greatest rate of penetration). This method requires drilling long stretches of earth utilizing less-than-optimal drilling parameters, slowing the drilling process and potentially damaging the drilling equipment. In addition, an unexpected change in the type of earth material being drilled may result in the drilling operator selecting what were acceptable parameters for drilling in one type of earth material, but continuing drilling with those parameters for a long time within another type of earth material in which those parameters are inefficient and potentially damaging.

In addition, weight on bit requirements may be estimated before drilling for the anticipated bottom hole assembly (i.e., the lower portion of the drill string which typically contains high weight elements providing the weight on bit). Conventionally, this may be performed by referring to the weight on bit capacity of the selected bit design and/or previous practice in similar formations and/or with similar bit designs. The weight on bit may be constrained by one or more elements of the drill string.

By contrast, methods 100 in accordance with this disclosure may employ real-time monitoring to determine an instantaneous average depth of cut of cutting elements of the earth-boring drill bit, enabling the weight on bit to be manually or automatically increased when the instantaneous average depth of cut is below a predetermined minimum depth of cut and confirm that the threshold has been crossed by a drop in specific energy followed by a constant specific energy level in the efficient, shearing dominated drilling mode. In addition, methods 100 in accordance with this disclosure may optionally employ pre-drilling simulations to provide recommendations for a minimum weight on bit to apply to reduce the likelihood that a depth of cut of cutting elements of the earth-boring drill bit will remove earth material by a less efficient primary cutting action (e.g., grinding). Methods 100 in accordance with this disclosure may further employ real-time monitoring to enable weight on bit to be further increased beyond the predetermined, recommended minimum weight on bit to increase rate of penetration while reducing the risk that the applied weight on bit will exceed a predetermined maximum weight on bit.

To facilitate such functionality, the method 100 may involve sensing a rotational speed of the drill string utilizing a first sensor operatively associated with the drill string, as indicated at 106. The first sensor may include, for example, a magnetoresistive sensor, a reflective sensor, an interrupter sensor, or an optical encoder. The first sensor may be positioned on or in the drill string and may be located, for example, proximate a kelly joint, proximate an upper opening of a borehole within the borehole, or proximate a lower end of a drilling rig (e.g., a derrick) above the borehole. An output of the first sensor may directly convey the rotational speed of the drill string in some embodiments. In other embodiments, a processing unit may convert the output of the first sensor into units corresponding to the rotational speed of the drill string. The output of the first sensor may be measured in numbers of rotations per unit of time (e.g., rotations per minute).

A rate of penetration of the drill string may also be sensed during advancement of the earth-boring drill bit utilizing a second sensor operatively associated with the drill string, as indicated at 108. The second sensor may include, for example, a potentiometer, a linear variable differential transformer, an inductive proximity sensor, or an incremental encoder. The second sensor may be positioned on or in the drill string and may be located, for example, proximate the kelly joint, proximate the upper opening of a borehole within the borehole, or proximate the lower end of a drilling rig (e.g., the derrick) above the borehole. An output of the second sensor may directly convey the rate of advancement of the drill string in some embodiments. In other embodiments, a processing unit may convert the output of the second sensor into units corresponding to the rate of penetration of the drill string. The output of the second sensor may be measured in linear distance per unit of time (e.g., feet per second). In some embodiments, each of the sensors and the control unit may be located at a surface (i.e., outside a borehole) of a drilling operation. Accordingly, deployment of the equipment for practicing methods in accordance with this disclosure may not require positioning additional equipment into the borehole or transferring sensed drilling parameters from within the borehole to the surface.

An instantaneous average depth of cut of cutting elements of the earth-boring drill bit may be determined utilizing a control unit operatively connected to the first and second sensors to calculate the instantaneous average depth of cut based on a sensed rotational speed of the drill string and a sensed speed of advancement of the drill string, as indicated at 110. The control unit may include a processing unit and nontransitory memory operatively connected to the processing unit. The instantaneous average depth of cut of the cutting elements of the earth-boring drill bit may be calculated, for example, utilizing the following algorithm:

$$DOC = \frac{ROP}{RPM \times \text{Redundancy}}$$

wherein DOC is the instantaneous average depth of cut, ROP is the sensed rate of penetration, RPM is the sensed rotational speed of the drill string, and Redundancy is the sum of diameters of the cutting elements of the earth-boring drill bit divided by a radius of the earth-boring drill bit.

As a specific, nonlimiting example, the instantaneous average depth of cut may be calculated utilizing the following formula when the rate of penetration is sensed in feet per hour and the rotational speed is sensed in rotations per minute:

$$DOC = \frac{ROP}{5 \times RPM \times \text{Redundancy}}$$

As another specific, nonlimiting example, the instantaneous average depth of cut may be calculated utilizing the following formula when the rate of penetration is sensed in meters per hour and the rotational speed is sensed in rotations per minute:

$$DOC = \frac{ROP}{16.67 \times RPM \times \text{Redundancy}}$$

The instantaneous average depth of cut obtained using such techniques may be expressed in terms of penetration depth per revolution per cutting element. Although the instantaneous average depth of cut so determined may not perfectly measure the actual depth of cut of a given cutting element, it may better provide a more reliable indicator of whether the weight on bit should be increased when compared to simply using the depth of penetration of the earth-boring drill bit per revolution as a proxy for the depth of cut.

Such techniques may represent an improvement over conventional processes of determining or estimating the depth of cut at least in part because it may employ real-time, real-world data from sensors to determine the instantaneous average depth of cut. In addition, the foregoing techniques may represent an improvement over conventional processes of determining or estimating the depth of cut because it may account for the redundant, radial overlap of portions of cutting elements distributed over a face of the earth-boring tool. The foregoing techniques may represent an improvement over conventional processes of determining or estimating the depth of cut because they may more accurately reflect the actual depth of cut of a given cutting element when compared to using the rate of penetration per revolution of the earth-boring drill bit as a proxy for the depth of cut. Finally, the foregoing techniques may represent an improvement over conventional processes of determining or estimating the depth of cut in some embodiments because they may produce a more reliable indicator of whether the weight on bit should be increased without requiring the deployment of additional sensors and equipment into the borehole or transfer of sensed parameters to the surface.

The instantaneous average depth of cut may be compared to a predetermined minimum depth of cut stored in the non-transitory memory utilizing the control unit, as indicated at 112. The predetermined minimum depth of cut may be a threshold at and above which a primary cutting action of the cutting elements is more likely to be a shearing cutting action, and below which the primary cutting action of the cutting elements is more likely to be a grinding cutting action, for the expected earth formation, fluid pressure regime, configuration of earth-boring drill bit, and type and orientation of cutting elements. For example, drilling simulations known in the art may be executed on a computing device utilizing iteratively varied depths of cut for the expected earth formation or formations to be drilled and the expected earth-boring drill bit to be used. The predetermined minimum depth of cut may vary over the course of a planned drill path as the expected or actual type of earth material being drilled changes. Accordingly, the predetermined minimum depth of cut stored in the non-transitory memory may be a single value or a set of values corresponding to separate drilling intervals (e.g., within a given type of earth material, along a predetermined distance). Generally speaking, the predetermined minimum depth of cut for removing carbonate rock (e.g., limestone, calcium carbonate, dolomite) utilizing a fixed-cutter, earth-boring drill bit may be, for example, about 0.02 inch (about 0.5 mm) or more. More specifically, the predetermined minimum depth of cut may be, for example, between about 0.03 inch (about 0.8 mm) and about 0.1 inch (about 25 mm) or more. As specific, nonlimiting examples, the predetermined minimum depth of cut may be between about 0.04 inch (about 1 mm) and about 0.15 inch (about 3.8 mm), about 0.05 inch (about 1.2 mm) and about 0.2 inch (about 5 mm), between any combination of the foregoing minimums and maximums.

The weight on the earth-boring drill bit may be increased via the drawworks when the instantaneous average depth of cut is less than the predetermined minimum depth of cut, as indicated at 114. By increasing the weight on the earth-boring drill bit, the depth of cut of the cutting elements of the earth-boring drill bit may be increased. Maintaining the depth of cut of the cutting elements above the predetermined minimum depth of cut may reduce the likelihood that the cutting elements will remove earth material by a grinding primary cutting action. In addition, doing so may increase the likelihood that the cutting elements will remove earth material by a shearing primary cutting action. Accordingly, the efficiency of the drilling operation may be increased, the wear on the earth-boring drill bit and its cutting elements per unit volume of earth material removed may be reduced, and the time to remove a given volume of earth material may be reduced.

In some embodiments, increasing the weight on the earth-boring drill bit via the drawworks may be accomplished automatically by a control unit operatively connected to the drawworks. For example, the control unit may send a signal to the drawworks, responsive to which the drawworks may automatically increase the weight on the earth-boring drill bit.

In other embodiments, increasing the weight on the earth-boring drill bit via the drawworks may be accomplished at least partially by a human drilling operator. For example, the control unit may cause an electronic display operatively connected to the control unit to display an instruction to increase the weight on the earth-boring drill bit when the instantaneous average depth of cut is less than the predetermined minimum depth of cut. The instruction may take the form of, for example, a string of text instructing the drilling operator to increase the weight on bit (e.g., "Increase Weight on Bit"). As another example, the instruction may display the calculated instantaneous average depth of cut with an associated color to instruct the drilling operator to increase the weight on bit (e.g., "0.01 in" in a designated area colored red, "0.01 in" in a red font). The human drilling operator may then interact with a user input device (e.g., a keyboard, a button, a lever, a dial) to cause the drawworks to increase the weight on bit.

In some embodiments, the control unit may at least substantially continually calculate the instantaneous average depth of cut, compare the calculated instantaneous average depth of cut to the predetermined minimum depth of cut, and generate information and instructions regarding the status of the drilling operation. For example, the control unit may calculate the instantaneous average depth of cut, compare the calculated instantaneous average depth of cut to the predetermined minimum depth of cut, and generate information and instructions regarding the status of the drilling operation at least once per minute (e.g., once per second). The information and instructions generated by the control unit may include causing the electronic display to display and update the calculated instantaneous average depth of cut with an associated color to give feedback and instructions to the drilling operator. For example, the control unit may cause the electronic display to display a first color in a designated area thereon when the instantaneous average depth of cut is greater than the predetermined minimum depth of cut and to display a second, different color in the designated area when the instantaneous average depth of cut is less than the predetermined minimum depth of cut. More specifically, displaying the calculated instantaneous average depth of cut in a field of red or in a red font may instruct the drilling operator to increase weight on bit; displaying the calculated instantaneous average depth of cut in a field of yellow or in a yellow font may warn the drilling operator that the current depth of cut is approaching the predetermined minimum depth of cut (e.g., is about 0.01 inch (about 0.25 mm) or less deeper than the predetermined minimum depth of cut), such that the drilling operator should consider increasing or prepare to increase the weight on bit; displaying the calculated instantaneous average depth of cut in a field of green or in a green font may inform the drilling operator that the current weight on bit is sufficient to achieve the predetermined minimum depth of cut or more.

In some embodiments, the instantaneous applied weight on bit may be monitored in addition to calculating the instantaneous average depth of cut. For example, the weight applied to the earth-boring drill bit via the drawworks and drill string may be sensed utilizing a third sensor operatively associated with the drawworks and operatively connected to the control unit. The third sensor may include, for example, a strain gauge, a piezoelectric load cell, a hydraulic load cell, or a pneumatic load cell. The sensed weight on bit may be compared to a predetermined minimum weight applicable to the earth-boring drill bit stored in the non-transitory memory. The weight on the earth-boring drill bit may be increased when the sensed weight applied to the earth-boring drill bit is less than the predetermined minimum weight applicable to the earth-boring drill bit. Like the predetermined minimum depth of cut, the predetermined minimum weight on bit may be determined by iteratively simulating drilling the earth formation to find a lowest weight applied to the earth-boring drill bit that still achieves the predetermined minimum depth of cut. The predetermined minimum weight on bit may be, for example, about 10,000 lbs. (about 4,500 kg) or less.

In some embodiments, the sensed weight applied to the earth-boring drill bit may be compared to a predetermined maximum weight applicable to the earth-boring drill bit stored in the non-transitory memory. When the sensed weight applied to the earth-boring drill bit is proximate the predetermined maximum weight applicable to the earth-boring drill bit the control unit or drilling operator may cause the drawworks to stop increasing weight on the earth-boring drill bit. The predetermined maximum weight applicable to the earth-boring drill bit may be selected from the lowest of a weight at which the drill string will buckle, a weight at which the earth-boring drill bit will exhibit stick-slip behavior, a weight at which a torque limit of a rotational driver of the drill string will be exceeded, and a weight at which the earth-boring drill bit or one or more components of the drill string will experience catastrophic failure. Like the predetermined minimum depth of cut and predetermined minimum weight on bit, the predetermined maximum weight on bit may be determined by iteratively simulating drilling the earth formation to find a lowest weight applied to the earth-boring drill bit that causes the drilling operation to fail, such as, for example, in one of the aforementioned ways. The predetermined maximum weight on bit may be, for example, about 50,000 lbs (about 22,000 kg) or more.

Figure 2:
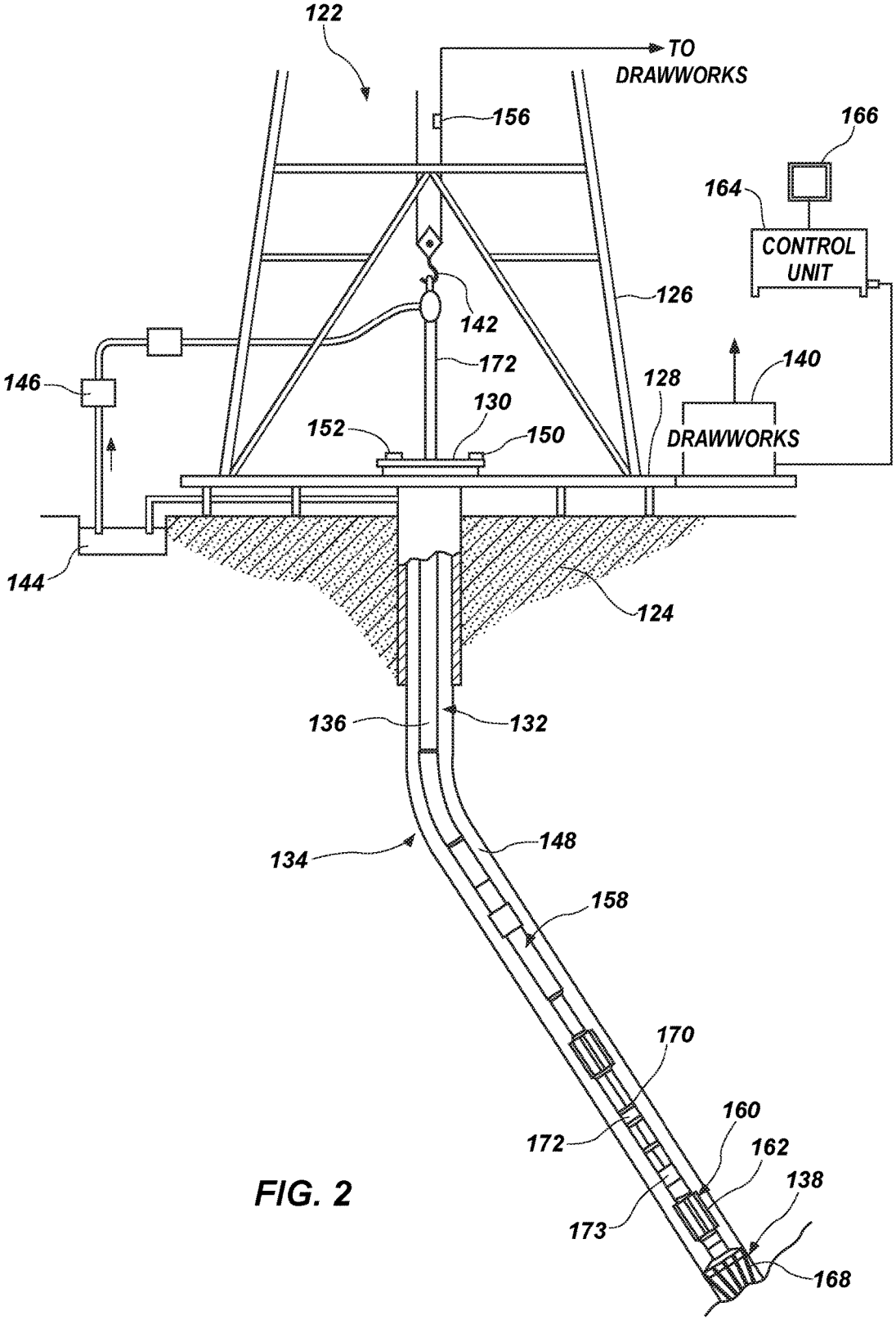
FIG. 2 is a schematic view of a drilling assembly configured to drill into an earth formation and practice methods described in connection with FIG. 1.

FIG. 2 is a schematic view of a drilling assembly 122 configured to drill into an earth formation 124 and practice the methods 100 described previously in connection with FIG. 1. The drilling assembly 122 may include a derrick 126 erected on a floor 128, which may support a rotary table 130 rotated by a prime mover such as an electric motor at a desired rotational speed. A drill string 132 supported by the derrick 126 and deployed in a borehole 134 in the earth formation 124 may include drill pipe 136 extending downward from the rotary table 130 into the borehole 134. A bottom hole assembly including a drill bit 138, drill collars, and any other drilling tools, which may be the primary source of weight to be applied to the drill bit 138, located at an end of the drill string 132 may engage with the earth formation 124 when it is rotated to drill the borehole 134. The drill string 132 may be coupled to a drawworks 140 (e.g., using a kelly joint 142). During the drilling operation the drawworks 140 may control the weight on bit.

During drilling operations, a drilling fluid 144 may be circulated under pressure through the drill string 132, and the rate of flow may be controlled by determining the operating speed of a pump 146. The drilling fluid 144 may be discharged at a bottom of the borehole 134 through openings (e.g., nozzles) in the drill bit 138. The drilling fluid 144 may then flow back up to the surface through the annular space 148 between the drill string 132 and walls of the borehole 134 for recirculation.

A first sensor 150 (e.g., a magnetoresistive sensor, a reflective sensor, an interrupter sensor, an optical encoder) oriented toward the drill string 132 and located, for example, proximate the kelly joint 142, proximate an upper opening of the borehole 134, or proximate a lower end of the derrick 126 may sense a rotational speed of the drill string 132. A second sensor 152 (e.g., a potentiometer, a linear variable differential transformer, an inductive proximity sensor, an incremental encoder) oriented toward the drill string 132 and located, for example, proximate the kelly joint 142, proximate an upper opening of the borehole 134, or proximate a lower end of the derrick 126 may sense a rate of penetration of the drill string 132 during advancement of the earth-boring drill bit 138. A third sensor 156 (e.g., a strain gauge, a piezoelectric load cell, a hydraulic load cell, a pneumatic load cell) associated with the kelly joint 142 may measure the hook load of the drill string 132 to measure or at least approximate the weight on bit.

The drill bit 138 may be rotated by rotating the entire drill string 132 when drilling certain portions of the borehole 134. In other portions, such as, for example, when changing drilling direction, the drill string and a downhole motor 158 may rotate the drill bit 138 through a drive shaft extending between the motor 158 and the drill bit 138. A steering unit 162 with a bearing assembly 160 may, depending upon its configuration, position the drill bit 138 centrally within the borehole 134 or may bias the drill bit 138 toward a desired direction. The drill bit 138 may contain sensors 168 configured to determine characteristics of the downhole environment and drilling dynamics. Sensors 170 and 172 may also be positioned on the drill string 132 and be configured to determine the inclination and azimuth of the drill string 132, the position of drill bit 138, borehole quality, and the characteristics of the formation being drilled. Additional details and equipment for a drilling assembly 122 configured to collect information regarding the characteristics of an earth formation, operational parameters, and equipment used are disclosed in U.S. Patent App. Pub. No. 2014/0136138, published May 15, 2014, and titled "DRILL BIT SIMULATION AND OPTIMIZATION."

A surface control unit 164 may receive signals from the sensors 150, 152, 156, 168, 170 and 172 and any other sensors used in the drilling assembly 122 and process the signals according to programmed instructions. The sensor signals may be provided at selected time intervals, at depth intervals along the drill path, at reduced intervals during drilling of nonlinear portions of the borehole, or a combination thereof. The surface control unit 164 may display current operating parameters, output recommended operating parameters, and other information on an electronic display 166, which may be utilized by an operator to control the drilling operations. The surface control unit 164 may be a computing system, as described in greater detail in connection with FIG. 3. The surface control unit 164 may be configured to accept inputs (e.g., via the sensors 150, 152, 156, 168, and 170 or via a user input device) and execute the methods 100 described previously in connection with FIG. 1, including simulating drilling operations and improving aspects of an active drilling operation through corrective measures comprising alteration of operating parameters (e.g., increasing or decreasing weight on bit and rpm).

In other embodiments, a downhole control unit 173 may receive the signals from the sensors 150, 152, 156, 168, 170 and 172 and any other sensors used in the drilling assembly 122 and process the signals according to programmed instructions. The downhole control unit 173 may send the results of the processed signals (e.g., current downhole conditions, current position, position relative to the predetermined drill path, current operating parameters, recommended operating parameters, current equipment deployed, and recommended equipment for deployment) to the electronic display 166 at the surface, which may be utilized by an operator to control the drilling operations. The downhole control unit 173 may be a computing system, as described in greater detail in connection with FIG. 3. The downhole control unit 173 may be configured to accept inputs (e.g., via the sensors 150, 152, 156, 168, 170 and 172 or via a user input device) and execute the methods 100 described previously in connection with FIG. 1, including simulating drilling operations and improving aspects of an active drilling operation through corrective measures comprising alteration of operating parameters (e.g., increasing or decreasing weight on bit).

Figure 3:
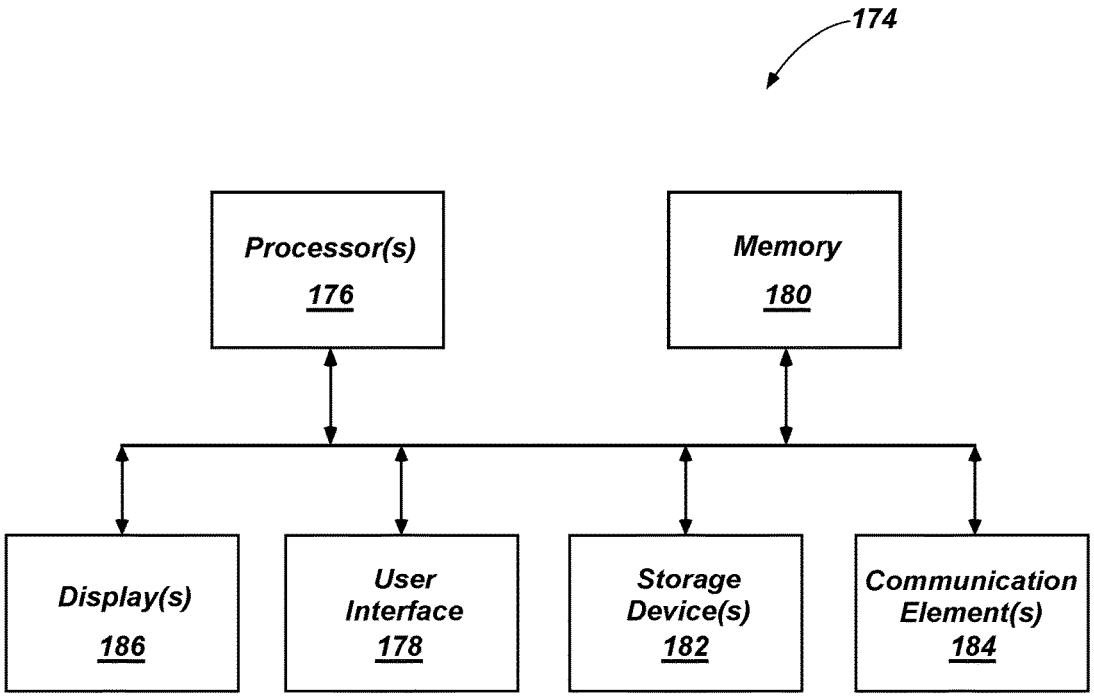
FIG. 3 is a block diagram of a computing system configured to practice methods described in connection with FIG. 1.

FIG. 3 is a block diagram of a computing system 174 configured to practice methods of FIG. 1. The computing system 174 may be a user-type computer, a file server, a computer server, a notebook computer, a tablet, a handheld device, a mobile device, or other similar computer system for executing software. The computing system 174 may be configured to execute software programs containing computing instructions and may include one or more processors 176, memory 180, one or more displays 186, one or more user interface elements 178, one or more communication elements 184, and one or more storage devices 182 (also referred to herein simply as storage 182).

The processors 176 may be configured to execute a wide variety of operating systems and applications including the computing instructions for performing the methods 100 discussed previously in connection with FIG. 1.

The memory 180 may be used to hold computing instructions, data, and other information for performing a wide variety of tasks including determining instantaneous average depth of cut and controlling components of drilling rigs in accordance with methods of the present disclosure. By way of example, and not limitation, the memory 180 may include Synchronous Random Access Memory (SRAM), Dynamic RAM (DRAM), Read-Only Memory (ROM), Flash memory, and the like.

The display 186 may be a wide variety of displays such as, for example, light emitting diode displays, liquid crystal displays, cathode ray tubes, and the like. In addition, the display 186 may be configured with a touch-screen feature for accepting user input as a user interface element 178.

As nonlimiting examples, the user interface elements 178 may include elements such as displays, keyboards, push-buttons, mice, joysticks, haptic devices, microphones, speakers, cameras, and touchscreens.

As nonlimiting examples, the communication elements 184 may be configured for communicating with other devices or communication networks. As nonlimiting examples, the communication elements 184 may include elements for communicating on wired and wireless communication media, such as for example, serial ports, parallel ports, Ethernet connections, universal serial bus (USB) connections, IEEE 1394 ("firewire") connections, Thunderbolt™ connections, Bluetooth® wireless networks, ZigBee wireless networks, 802.11 type wireless networks, cellular telephone/data networks, and other suitable communication interfaces and protocols.

The storage devices 182 may be used for storing relatively large amounts of nonvolatile information for use in the computing system 174 and may be configured as one or more storage devices. By way of example, and not limitation, these storage devices may include computer-readable media (CRM). This CRM may include, but is not limited to, magnetic and optical storage devices such as disk drives, magnetic tape, CDs (compact discs), DVDs (digital versatile discs or digital video discs), and semiconductor devices such as RAM, DRAM, ROM, EPROM, Flash memory, and other equivalent storage devices.

A person of ordinary skill in the art will recognize that the computing system 174 may be configured in many different ways with different types of interconnecting buses between the various elements. Moreover, the various elements may be subdivided physically, functionally, or a combination thereof. As one nonlimiting example, the memory 180 may be divided into cache memory, graphics memory, and main memory. Each of these memories may communicate directly or indirectly with the one or more processors 176 on separate buses, partially-combined buses, or a common bus.

The computing system 174 may be configured to accept inputs (e.g., via the user interface elements 178 or other inputs) and execute the methods 100 described previously in connection with FIG. 1, including simulating drilling operations to improve aspects of an active drilling operation and improving aspects of an active drilling operation through corrective measures comprising alteration of operating parameters (e.g., increasing or decreasing weight on bit).

Figure 4:
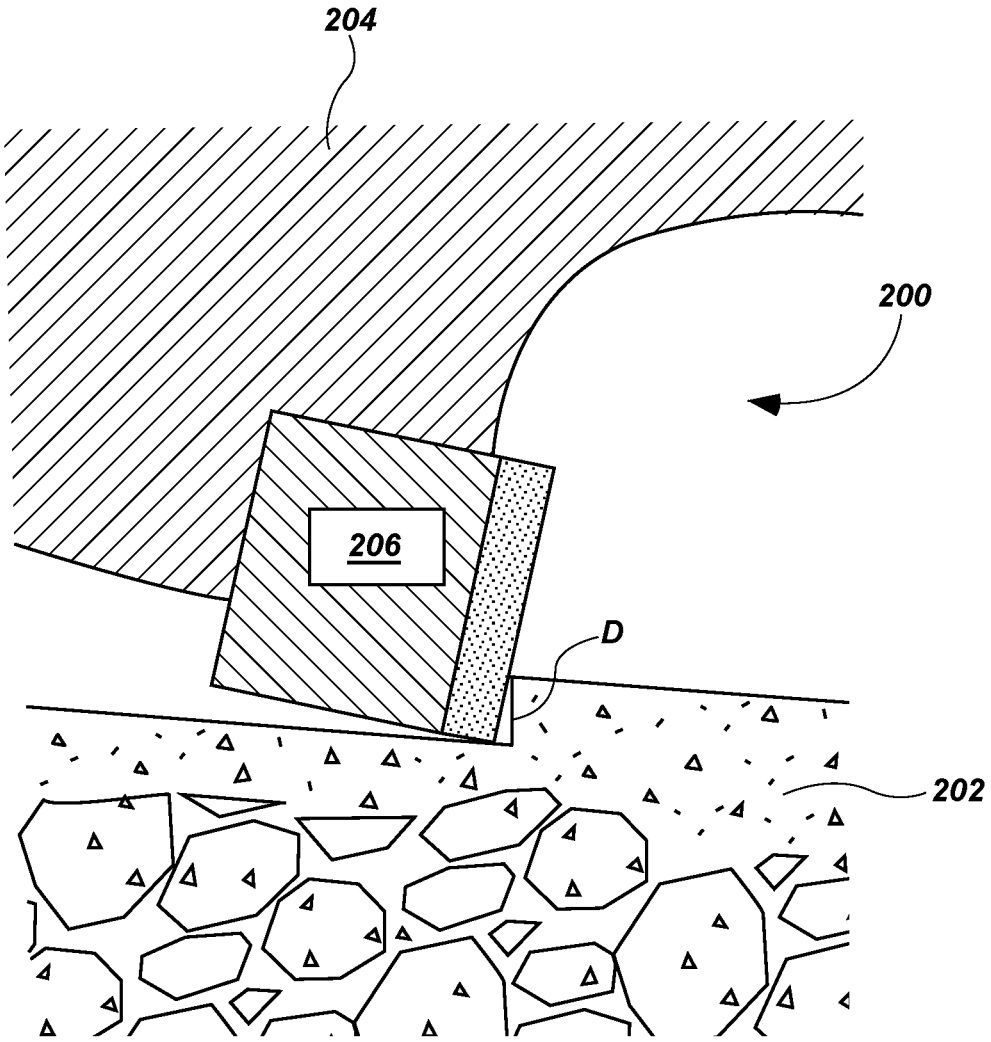
FIG. 4 is a simplified cross-sectional side view of a portion of an earth-boring drill bit engaging an underlying earth formation.

FIG. 4 is a simplified cross-sectional side view of a portion of an earth-boring drill bit 200 engaging an underlying earth formation 202. The earth-boring drill bit 200 may include a body 204 having at least some shearing cutting elements 206 fixedly attached thereto. As the earth-boring drill bit 200 rotates within the borehole, at least some of the shearing cutting elements 206 may engage the underlying earth formation 202 to facilitate its removal. A depth D by which a given cutting element 206 penetrates into the earth formation 202 may be the depth of cut. Utilizing the methods and systems discussed in this application, the depth D may better be maintained above a predetermined minimum depth of cut to increase efficiency of the drilling operation, reduce the wear on the earth-boring drill bit and its cutting elements per unit volume of earth material removed, and reduce the time to remove a given volume of earth material.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may be made to produce embodiments within the scope of this disclosure, such as those specifically claimed, including legal equivalents. In addition, features from one disclosed embodiment may be combined with features of another disclosed embodiment while still being within the scope of this disclosure, as contemplated by the inventors.

What is claimed is:

1. A system for drilling into an earth formation, comprising:

an earth-boring drill bit comprising fixed cutting elements configured to engage with and remove an underlying earth formation;

a drill string configured to be connected to the earth-boring drill bit to transfer longitudinal and rotational loads to the earth-boring drill bit;

a drawworks configured to suspend the earth-boring drill bit and the drill string and to apply weight to the earth-boring drill bit via the drill string to advance the earth-boring drill bit into the underlying earth formation;

a first sensor operatively associated with the drill string, the first sensor configured to sense a rotational speed of the drill string;

a second sensor operatively associated with the drill string, the second sensor configured to sense a rate of penetration of the drill string during advancement of the earth-boring drill bit; and a control unit operatively connected to the first and second sensors and to the drawworks, the control unit comprising a processing unit and non-transitory memory operatively connected to the processing unit, the processing unit programmed to:

determine an instantaneous average depth of cut of the cutting elements of the earth-boring drill bit utilizing a sensed rotational speed of the drill string and a sensed speed of advancement of the drill string utilizing the following algorithm:

$$DOC = \frac{ROP}{RPM \times \text{Redundancy}}$$

wherein DOC is the instantaneous average depth of cut, ROP is the sensed rate of penetration, RPM is the sensed rotational speed of the drill string, and Redundancy is a sum of diameters of the cutting elements of the earth-boring drill bit divided by a radius of the earth-boring drill bit;

compare the instantaneous average depth of cut to a predetermined minimum depth of cut stored in the nontransitory memory; and cause the drawworks to increase weight on the earth-boring drill bit when the instantaneous average depth of cut is less than the predetermined minimum depth of cut.

2. The system of claim 1, further comprising a third sensor operatively associated with the drawworks, the third sensor configured to sense the weight applied to the earth-boring drill bit via the drawworks and drill string, the third sensor operatively connected to the control unit.

3. The system of claim 2, wherein the processing unit is further programmed to:

compare a sensed weight applied to the earth-boring drill bit to a predetermined minimum weight applicable to the earth-boring drill bit stored in the nontransitory memory; and cause the drawworks to increase weight on the earth-boring drill bit when the sensed weight applied to the earth-boring drill bit is less than the predetermined minimum weight applicable to the earth-boring drill bit.

4. The system of claim 3, wherein the processing unit is further programmed to:

compare the sensed weight applied to the earth-boring drill bit to a predetermined maximum weight applicable to the earth-boring drill bit stored in the nontransitory memory; and cause the drawworks to stop increasing weight on the earth-boring drill bit when the sensed weight applied to the earth-boring drill bit is proximate the predetermined maximum weight applicable to the earth-boring drill bit.

5. The system of claim 2, wherein the third sensor comprises a strain gauge.

6. The system of claim 1, wherein the first sensor comprises a magnetoresistive sensor, a reflective sensor, an interrupter sensor, or an optical encoder.

7. The system of claim 1, wherein the second sensor comprises a potentiometer, a linear variable differential transformer, an inductive proximity sensor, or an incremental encoder.

8. The system of claim 1, wherein the predetermined minimum depth of cut is about 0.02 inch or more.

9. A method of drilling an earth formation, comprising:

removing a portion of an underlying earth formation utilizing fixed cutting elements on an earth-boring drill bit;

applying weight to the earth-boring drill bit utilizing a drawworks connected to the earth-boring drill bit via a drill string to advance the earth-boring drill bit into the underlying earth formation;

sensing a rotational speed of the drill string utilizing a first sensor operatively associated with the drill string;

sensing a rate of penetration of the drill string during advancement of the earth-boring drill bit utilizing a second sensor operatively associated with the drill string;

determining an instantaneous average depth of cut of cutting elements of the earth-boring drill bit utilizing a control unit operatively connected to the first and second sensors to calculate the instantaneous average depth of cut based on a sensed rotational speed of the drill string and a sensed speed of advancement of the drill string utilizing the following algorithm:

$$DOC = \frac{ROP}{RPM \times \text{Redundancy}}$$

wherein DOC is the instantaneous average depth of cut, ROP is the sensed rate of penetration, RPM is the sensed rotational speed of the drill string, and Redundancy is a sum of diameters of the cutting elements of the earth-boring drill bit divided by a radius of the earth-boring drill bit, and wherein the control unit comprises a processing unit and non-transitory memory operatively connected to the processing unit;

comparing the instantaneous average depth of cut to a predetermined minimum depth of cut stored in the non-transitory memory utilizing the control unit; and causing the drawworks to increase the weight on the earth-boring drill bit when the instantaneous average depth of cut is less than the predetermined minimum depth of cut.

10. The method of claim 9, further comprising displaying an instruction to increase the weight on the earth-boring drill bit utilizing an electronic display operatively connected to the control unit when the instantaneous average depth of cut is less than the predetermined minimum depth of cut.

11. The method of claim 10, wherein causing the drawworks to increase weight on the earth-boring drill bit comprises a drilling operator operating the drawworks to increase weight on the earth-boring drill bit.

12. The method of claim 10, wherein displaying the instruction to increase the weight on the earth-boring drill bit utilizing the electronic display comprises displaying a first color in a designated area on the electronic display when the instantaneous average depth of cut is greater than the predetermined minimum depth of cut and displaying a second, different color in the designated area on the electronic display when the instantaneous average depth of cut is less than the predetermined minimum depth of cut.

13. The method of claim 9, further comprising sensing the weight applied to the earth-boring drill bit via the drawworks and drill string utilizing a third sensor operatively associated with the drawworks, the third sensor operatively connected to the control unit.

14. The method of claim 13, further comprising:

comparing a sensed weight applied to the earth-boring drill bit to a predetermined minimum weight applicable to the earth-boring drill bit stored in the non-transitory memory; and causing the drawworks to increase weight on the earth-boring drill bit when the sensed weight applied to the earth-boring drill bit is less than the predetermined minimum weight applicable to the earth-boring drill bit.

15. The method of claim 13, further comprising:

comparing the sensed weight applied to the earth-boring drill bit to a predetermined maximum weight applicable to the earth-boring drill bit stored in the non-transitory memory; and causing the drawworks to stop increasing weight on the earth-boring drill bit when the sensed weight applied to the earth-boring drill bit is proximate the predetermined maximum weight applicable to the earth-boring drill bit.

16. The method of claim 15, wherein causing the drawworks to stop increasing weight on the earth-boring drill bit when the sensed weight applied to the earth-boring drill bit is proximate the predetermined maximum weight applicable to the earth-boring drill bit comprises causing the drawworks to stop increasing weight on the earth-boring drill bit when the sensed weight applied to the earth-boring drill bit is proximate at least one of a weight at which the drill string will buckle, a weight at which the earth-boring drill bit will exhibit stick-slip behavior, a weight at which a torque limit of a rotational driver of the drill string will be exceeded, and a weight at which the earth-boring drill bit or any other component of the drill string will experience catastrophic failure.

17. The method of claim 14, further comprising simulating drilling the earth formation to generate the predetermined minimum weight applicable to the earth-boring drill bit by iteratively finding a lowest weight applied to the earth-boring drill bit to achieve the predetermined minimum depth of cut.

18. The method of claim 9, wherein causing the drawworks to increase weight on the earth-boring drill bit comprises the control unit automatically operating the drawworks to increase the weight on the earth-boring drill bit.

* * * * *